US008839958B2

(12) United States Patent
Jonninen

(10) Patent No.: US 8,839,958 B2
(45) Date of Patent: Sep. 23, 2014

(54) METHOD AND DEVICE FOR SCREENING MATERIALS, SUCH AS AGGREGATES AND/OR SOILS

(71) Applicant: Salmonbay Consulting Oy, Lohilahti (FI)

(72) Inventor: Markku Jonninen, Lohilahti (FI)

(73) Assignee: Salmonbay Consulting Oy (FI)

( * ) Notice: Subject to any disclaimer, the term of this patent is extended or adjusted under 35 U.S.C. 154(b) by 0 days.

(21) Appl. No.: 13/648,729

(22) Filed: Oct. 10, 2012

(65) Prior Publication Data

US 2013/0092607 A1 Apr. 18, 2013

(30) Foreign Application Priority Data

Oct. 13, 2011 (FI) ..... 20116017

(51) Int. Cl.
*B07B 1/28* (2006.01)
*B07B 1/44* (2006.01)
*B07B 1/46* (2006.01)

(52) U.S. Cl.
CPC . *B07B 1/286* (2013.01); *B07B 1/44* (2013.01); *B07B 1/4636* (2013.01)
USPC ..... 209/315; 209/326; 209/332; 209/365; 209/369

(58) Field of Classification Search
CPC ..... B07B 1/46; B07B 2201/04; B07B 1/42; B07B 1/30; B07B 1/36; B07B 1/38; B07B 1/284; B07B 1/286; B07B 1/50
USPC ..... 209/315, 325, 326, 332, 365, 369
See application file for complete search history.

(56) References Cited

U.S. PATENT DOCUMENTS 2,068,730 A * 1/1937 Behnke ..... 74/402
2,150,242 A * 3/1939 Overstrom ..... 209/326

(Continued)

FOREIGN PATENT DOCUMENTS

CN 102078860 A 6/2011
DE 368662 2/1923

(Continued)

OTHER PUBLICATIONS

Posten, Katharina, "European Search Report" in connection with related European Patent Application No. 12186003.5-1253, dated Jan. 11, 2013, 9 pages.

(Continued)

*Primary Examiner* — David H Bollinger
(74) *Attorney, Agent, or Firm* — Kolisch Hartwell, P.C.

(57) ABSTRACT

A method and a device for screening aggregates and/or soils with a screening deck, where each point of the screening deck revolves continuously in the same rotating direction along a circular path. This movement is effected by the fastening frame of the screening deck being bearing-mounted upon at least two eccentric shafts, where each eccentric shaft is in turn bearing-mounted on a device body with bearings, through the midpoints of which extends a rotation axis of the eccentric shaft. Additionally, a throw axis spaced from the rotation axis of the eccentric shaft extends through the midpoints of bearings present between each eccentric shaft and the fastening frame, so that when the device is in operation, the throw axis revolves around the rotation axis along a circular path continuously in the same direction. All mass forces of movable structural components have been balanced with respect to rotation axes.

13 Claims, 6 Drawing Sheets

(56) References Cited

U.S. PATENT DOCUMENTS

| | | | | |
|---|---|---|---|---|
| 2,597,503 | A | 5/1952 | Larsson | |
| 2,849,119 | A * | 8/1958 | Guess | 209/365.1 |
| 3,307,698 | A | 3/1967 | Haffner | |
| 4,057,492 | A | 11/1977 | Stasinski et al. | |
| 4,956,078 | A * | 9/1990 | Magerowski et al. | 209/254 |
| 5,328,036 | A * | 7/1994 | Douglas | 209/366.5 |

FOREIGN PATENT DOCUMENTS

| | | | |
|---|---|---|---|
| EP | 1 348 495 | A2 | 10/2003 |
| GB | 302813 | | 12/1928 |
| GB | 366886 | | 2/1932 |
| GB | 822664 | | 10/1959 |
| GB | 2058286 | A * | 4/1981 |

OTHER PUBLICATIONS

Finnish Search Report from corresponding Finland Application No. 20116017, dated Jul. 20, 2012, 1 page.

* cited by examiner

METHOD AND DEVICE FOR SCREENING MATERIALS, SUCH AS AGGREGATES AND/OR SOILS

The invention relates to a method for screening materials, such as aggregates and/or soils, said method comprising driving a meshed screening deck by machine power upon horizontal eccentric shafts eccentrically with respect to rotation axes bearing-mounted on a body, and forcing thereby each point of the screening deck to revolving motion continuously in the same rotating direction along a circular path.

The invention relates also to a device for screening materials, such as aggregates and/or soils, said device comprising a body, a meshed screening deck, a fastening frame for the screening deck, and not less than two horizontal eccentric shafts by which the screening deck is supported on the body to be driven relative to the body, as well as a motor for rotating the eccentric shafts, whereby each eccentric shaft is bearing-mounted on the body with first bearings through the midpoints of which extends a rotation axis of the eccentric shaft, and each eccentric shaft is bearing-mounted on the fastening frame of the screening deck with second bearings through the midpoints of which extends a throw axis which is spaced from the rotation axis of the eccentric shaft, whereby, when the device is operating, the throw axis revolves around the rotation axis along a circular path continuously in the same direction.

Prior known vibrating screens consume a lot of energy, i.e. the screening efficiency with respect to consumed energy is poor. In addition, the structures of prior known vibrating screens must be designed to withstand major forces and/or wear of the parts.

Currently available vibrating screens are generally based on a swing motion resulting from a centrifugal force caused by a screening deck mounted with cushion elements on a heavy screening element body and by a fast-rotating eccentric shaft attached thereto, the screening deck being thereby set in reciprocating motion. This solution makes it almost impossible to activate the screening in a loaded condition, i.e. the material to be screened may not be present on top of the screening deck at the time of activation because of a change in the screening deck weight and thereby in its natural vibration amplitude. This is why it is not easy to construct large vibrating screens on a batch operating principle, but, instead, such screens are first activated and feeding the material is only commenced after the natural vibration amplitude has been reached. For feeding purposes, vibrating screens are always provided with a separate feeding chute capable of metering a material to be treated onto the screening deck.

It is difficult to balance the forces caused by such an eccentric shaft rotation-based movement of a screening deck on a body attached thereto. In practice, the body is made so heavy, considerably heavier than the screening deck, that it is not substantially rocked by external forces resulting from the screening deck's cushion mechanisms.

Specification U.S. Pat. No. 2,597,503 discloses a screen device of the foregoing type, wherein the rotating eccentric shafts have counterweights 12 capable of balancing mass forces relative to throw shafts 4. Dynamic eccentric forces relative to rotating pins 5 have not been balanced, whereby the rotation of eccentric shafts applies by way of support bearings to the body a rotating counterforce working against the eccentric forces.

It is an object of the invention to substantially reduce these drawbacks.

This object is achieved with a method according to the invention on the basis of the characterizing features presented in the appended claim 1, and with a device according to the invention on the basis of the characterizing features presented in the appended claim 6.

One preferred exemplary embodiment of the invention will now be described more closely with reference to the accompanying drawings, in which FIG. 1 shows a screen device of the invention in a 3D view obliquely from below;

Figure 1:
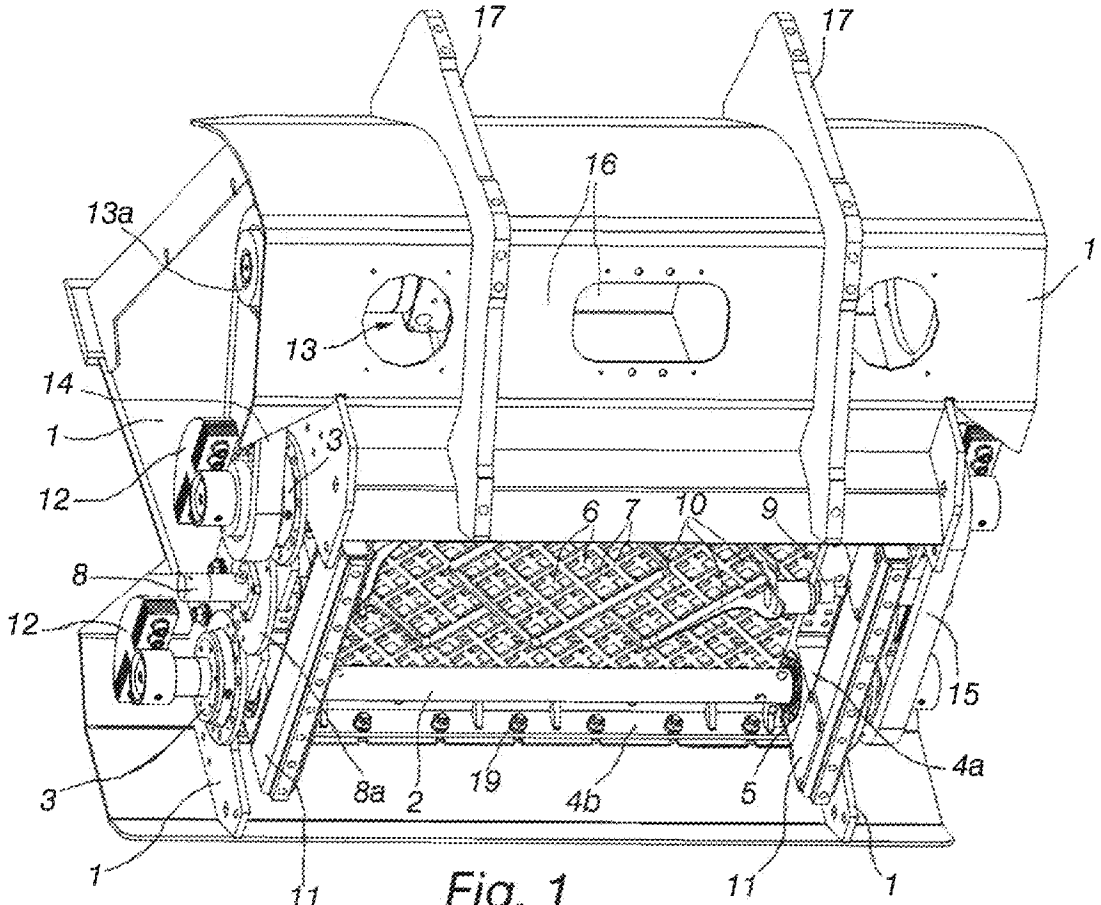

In the illustrated case, the screen device has been implemented in the bucket of an excavator, such that screening decks 6 and 7, attached to a fastening frame 4*a*, 4*b* as subsequently described, make up a bottom or a wall for a bucket type screen device 20. However, the screen device can also be implemented for a permanently immobile body. The fastening frame 4*a*, 4*b*, along with the screening decks 6 and 7, makes up a screening element.

The screening device includes also a body 1, which is constructed from panels and defines a screening space at the sides and ends of the screening decks 6 and 7. The material to be screened, such as aggregate and/or soil, is brought onto the screening decks 6 and 7 into the space defined by the body 1. The number of screening decks is at least one, but can be for example two as in the described embodiment.

Not less than two eccentric shafts 2 are bearing-mounted for rotation with bearings 3 attached to the side panels of the body 1. Hence, through the bearings 3 extend rotation axes 21 for the eccentric shafts 2.

In addition, each eccentric shaft 2 is bearing-mounted on the fastening frame 4*a*, 4*b* of the screening decks 6 and 7 with second bearings 5 through the midpoints of which extends a so-called throw axis 22 which is spaced from the rotation axis 21 of the eccentric shaft 2. As a result of this double bearing assembly, when the apparatus is operating, the throw axis revolves around the horizontal rotation axis along a circular path continuously in the same direction. Thus, such a double bearing assembly of the eccentric shafts 2 forces each point of the fastening frame 4*a* and 4*b* and the screening decks 6 and 7 (i.e. the screening element) to revolving motion continuously in the same direction along a circular path. The driving force is obtained by way of a gear 13*a* and a chain or a cogged belt from a motor 13 housed in a casing 16. In order to force the eccentric shafts 2 to rotate in the same direction in synchronism, the eccentric shafts 2 are linked to each other with a mechanical transmission element 15, such as a chain or a cogged belt.

Controlling rotational speed of the eccentric shafts 2 enables such an adjustment of the revolving motion speed of the screening decks 6 and 7 that the material to be screened is thrown by the screening decks over every cycle in the same advancing direction as regarded in the direction of the screening decks' plane. In practice, the rotating speed of the eccentric shafts 2 is adjusted to be such that the material to be screened disengages from the screening decks at its highest point, or optimally 45 to 15 degrees prior to the highest point, depending on whether it is desirable to increase a vertical or horizontal component in the throwing movement of a material to be screened.

To the ends of the eccentric shafts 2 extended through the body 1 are attached counterweights 12, which are in a high position whenever the screening decks 6 and 7 and the fastening frame 4*a*, 4*b* thereof are in a low position, the counterweights 12 thus balancing dynamic eccentric forces. In addition, to a bottom portion of the fastening frame 4*a*, 4*b* of the screening decks 6 and 7 are attached bottom weights 11, by which the center of mass of the screening decks 6 and 7 and the fastening frame 4*a*, 4*b* thereof (in other words, the screening element's center of mass) has been lowered to a location near or at the throw axis.

The above-mentioned practices can be used for balancing all mass forces of movable components with respect to the rotation axes 21. Thus, a center of gravity common to the masses of movable components lies at the height of a plane extending through the rotation axes 21, optimally at the center of this particular plane.

Consequently, the support bearings 3 are not subjected to forces generated by rotation. Particularly with regard to an attachment carried by the lengthy lifting booms of a bucket machine, it is important for the attachment to not burden the boom assembly with any sort of rotational vibrations or up/down vibrations.

Figure 5:
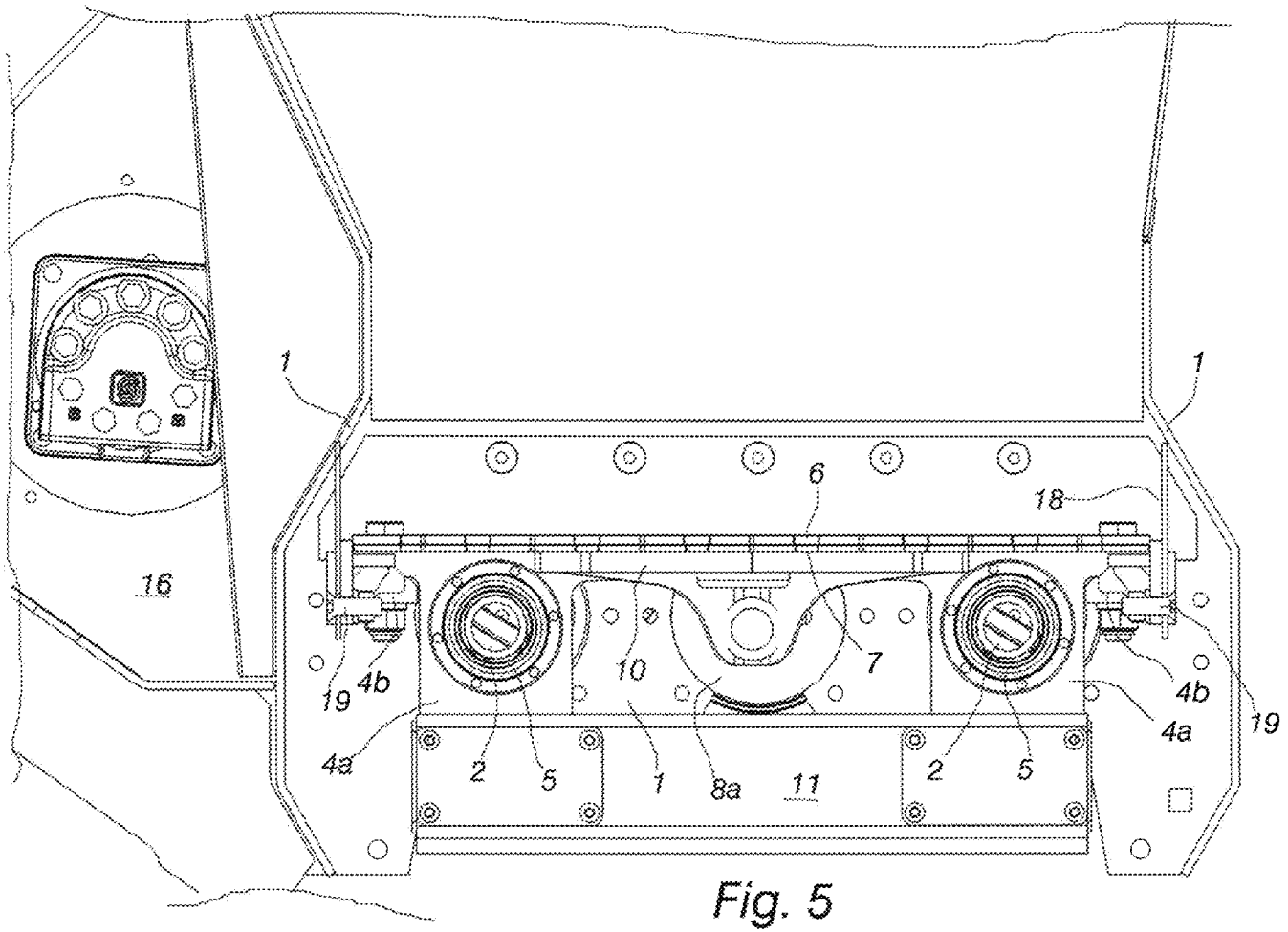
FIG. 5 shows the same screen device in a section perpendicular to eccentric shafts 2.
Figure 6:
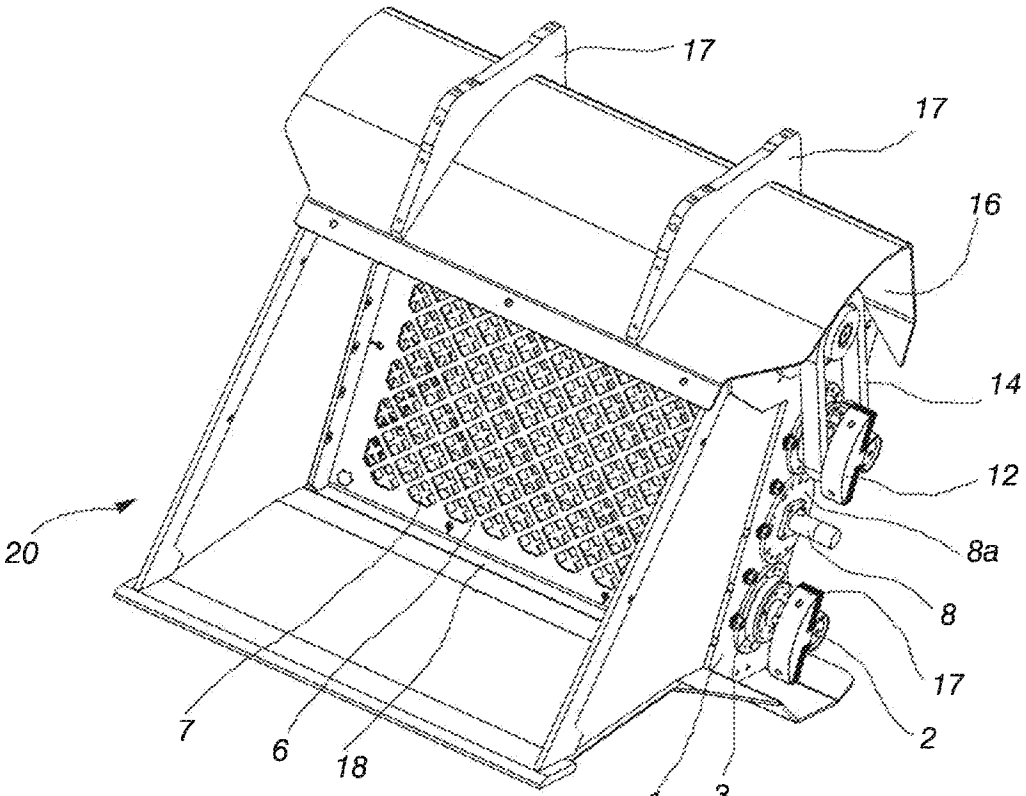
FIG. 6 shows the same screen device in a 3D view obliquely from above.

As can be seen from FIG. 5, the screening space is restricted by flexible sealing boards 18, which are capable of moving along with the screening decks 6 and 7 and the top edges of which drag along the immobile end panels of the body.

For the adjustment of screening coarseness, the screening element consists of two screening decks 6 and 7 on top of each other, the upper one 6 of which is attached to the screening element fastening frame 4*a*, 4*b*, and the lower one 7 is movable between the upper screening deck 6 and the fastening frame 4*a*, 4*b*.

Figure 2:
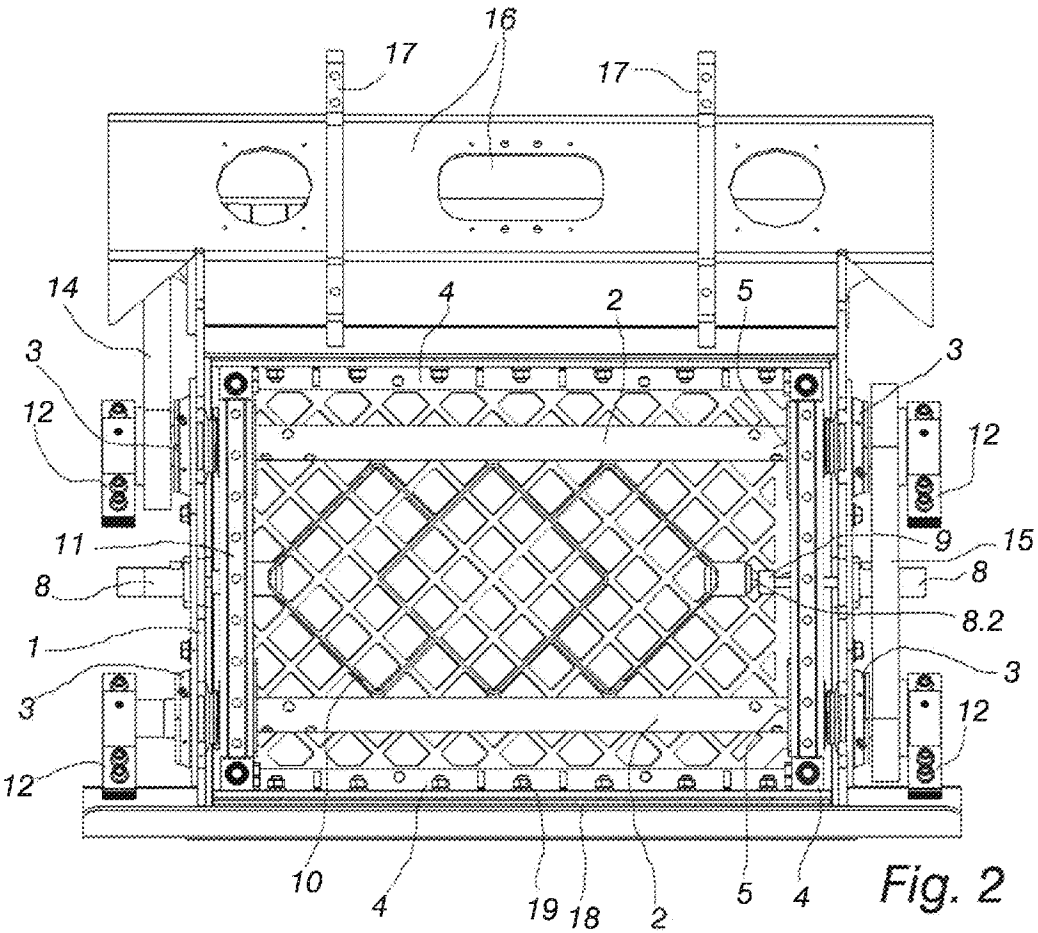
FIG. 2 shows the same screen device from below.
Figure 3:
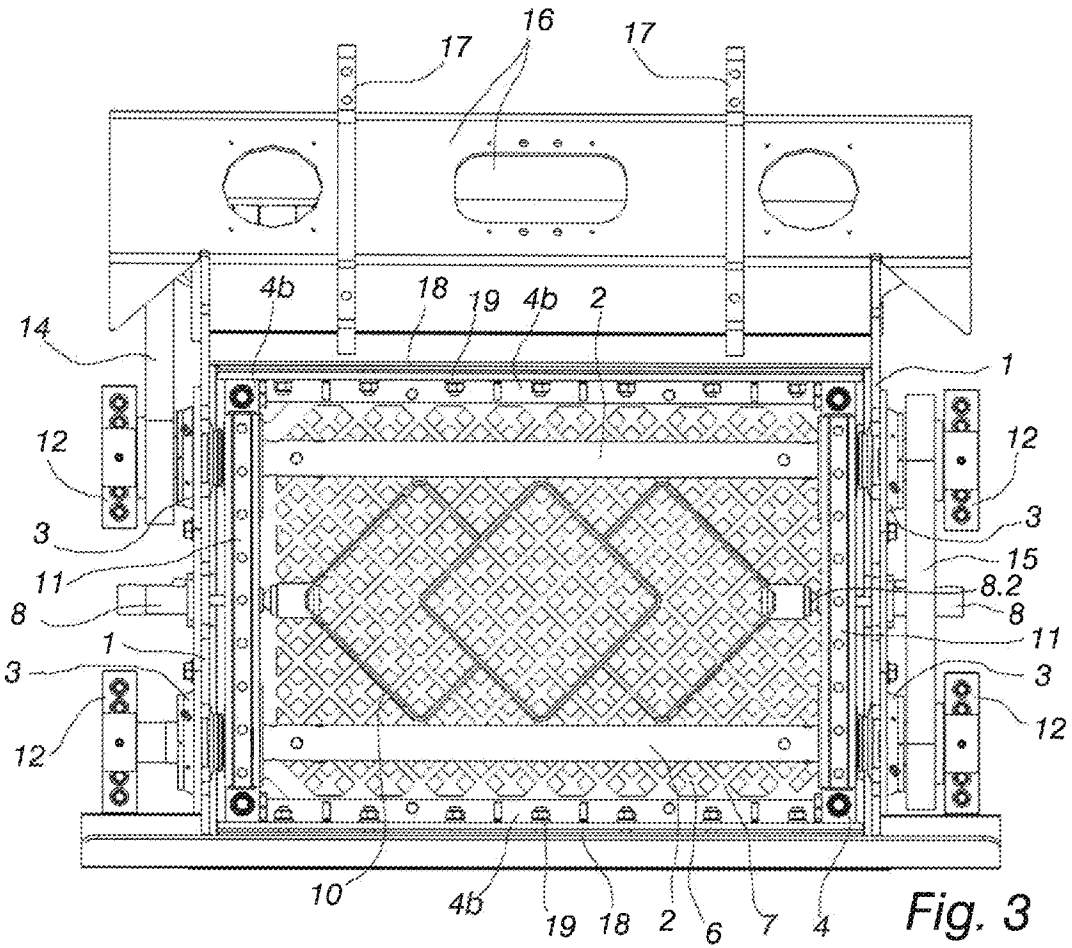
FIG. 3 shows the same screen device also from below, but with a lower screen mesh in an offset position for screening coarseness adjustment.
Figure 4:
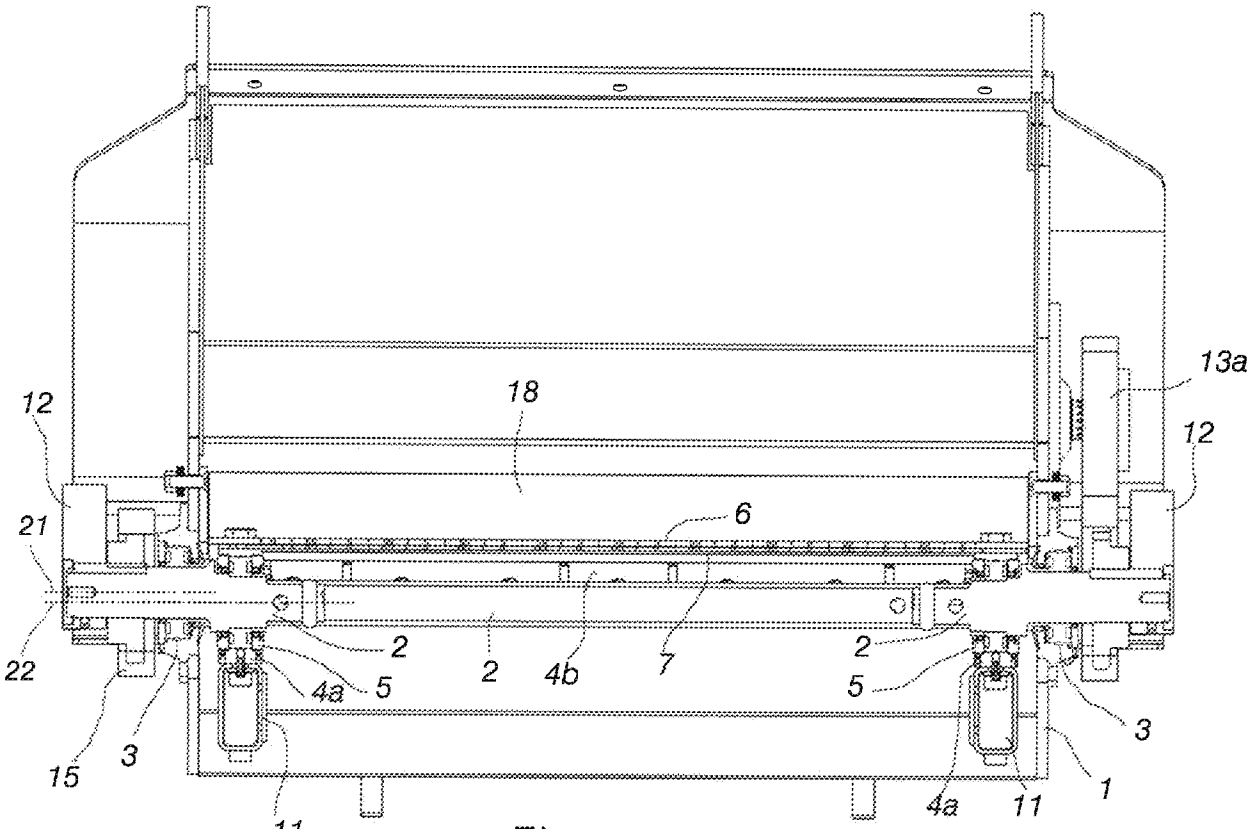
FIG. 4 shows the same screen device in a section at the eccentric shaft, illustrating a double bearing assembly for the eccentric shafts so as to establish a rotation axis and a throw axis offset relative to each other.

As can be seen by comparing FIGS. 2 and 3, the lower screening deck 7 is displaceable from a position covered by the upper screening deck 6 to a position in which the mesh-defining grates of the lower screening deck 7 coincide with the meshes of the upper screening deck. Both screening decks 6 and 7 have the same mesh spacing, but the lower screening deck 7 has a mesh size which is larger than that of the upper screening deck 6. Thus, the meshes expand downward and thus the screen is not susceptible to clogging.

Each screening deck 6 and 7 is a plate with holes, wherein the square-shaped holes establish a grid or a mesh type screen having its squares or meshes in an angular orientation with respect to the direction of the eccentric shafts 2. For mesh size adjustment, the mesh screen 7 is displaced in a direction transverse to a joint actuation direction of the mesh screens, whereby the mesh-defining grates of the lower mesh screen 7 coincide with the meshes of the upper mesh screen 6 and divide the same into a plurality of meshes. In the illustrated case (FIG. 3), each mesh of the upper mesh screen 6 is divided into four meshes constituted by the corners of four meshes in the lower mesh screen 7.

An alternative configuration for the screening deck 7 is such that, as opposed to what was described above, its displacement does not divide each mesh of the upper screen deck 6 into a plurality of meshes, but, instead, reduce the aperture area of each mesh.

The actuation of both screening decks 6 and 7 for screening work also proceeds angularly with respect to the square-shaped meshes.

The actuation of the lower screening deck 7 for a mesh size adjustment can be carried out in many ways. The figures depict one example of actuation means 8 by which the lower screening deck 7 is movable between the upper screening deck 6 and the fastening frame 4*a*, 4*b*. Through the intermediary of ball bearing-headed propelling elements 9 and by means of response surfaces 8.2 fixed to the lower screening deck, the power cylinders 8 present on either side are pushing the screening deck 7 in one way or the other. The actuation means can also be hand-operated or ratchet mechanisms capable of moving the screening deck 7 while the eccentric shafts 2 are rotated in a direction opposite to that used for screening.

The fastening frame for the screening decks 6 and 7 is made up by two side frames 4*a* provided with bottom weights 11, and by two cross frames 4*b* co-directional with the eccentric shafts 2 and having the sealing boards 18 fastened thereto with bolts 19.

In the invention, the energy consumption of a screening movement is low, because the eccentric shafts 2, which conduct the screening movement, also work at the same time as transmission shafts. The balanced masses are only moved along a circular path continuously in the same revolving direction.

Moreover, the screening coarseness is readily and quickly adjustable.

The screening decks are also replaceable according to a screening demand. Because the mesh size of a screening deck affects its mass, the balancing is necessary in connection with the replacement thereof. The balancing is conducted with the counterweights 12 and the bottom weights 11 by increasing or reducing the number of slabs in slab stacks.

Since it is advantageous to make the screening decks 6 and 7 as thin as possible for avoiding clogging, the screening deck has constructed on its bottom surface a reinforcing framework 10 capable of maintaining the screening decks as straight (flat) as possible irrespective of the weight of a material to be screened. However, a slight curvature does not impede the adjustment of a screening height, because the screening decks curve the same way and the range of motion required by the adjustment is relatively small.

The screening decks 6, 7 may also consist of bars, which are co-directional with the deck's movement and have the same equal spacing relative to each other, and of which the bars of the upper screening deck 6 are thicker than those of the lower screening deck 7. When the bars are on top of each other, the screening decks 6, 7 make up a grid rack whose fraction size is determined by a clear space between the bars of the upper screening deck 6. When a change of the fraction size is desired, it is by shifting the lower screening deck 7 over a distance equal to half of the bars' spacing that the screening decks 6, 7 establish a grid rack with smaller meshes.

According to the exemplary embodiment, the screen device designed for an excavator bucket can be fixed to the bucket's arm by attachment plates 17.

The invention claimed is:

1. A method for screening materials, comprising:

providing a device for screening materials, the device including a body;

a meshed screening deck;

a fastening frame for the screening deck;

at least two horizontal eccentric shafts supporting the screening deck on the body, where the eccentric shafts are configured to be driven relative to the body; and a motor configured for rotating the eccentric shafts;

wherein each eccentric shaft is bearing-mounted on the body with a first bearing such that a rotation axis of the eccentric shaft extends through a midpoint of the first bearing; and each eccentric shaft is bearing-mounted on the fastening frame of the screening deck with a second bearing such that a throw axis that is spaced from the rotation axis of the eccentric shaft extends through the midpoint of the second bearing;

the device being configured so that when the device is operating each throw axis revolves around the corresponding rotation axis along a circular path continuously in the same direction, the joint center of mass of movable structural components is disposed substantially along a plane that extends through and includes the rotation axes, and all mass forces of structural components are balanced with respect to the rotation axes; and driving the meshed screening deck upon the horizontal eccentric shafts, where the meshed screening deck is driven by machine power eccentrically with respect to the rotation axes, thereby forcing each point of the screening deck to revolve in continuous motion in the same rotational direction along a circular path.

2. The method of claim 1, wherein driving the meshed screening deck includes maintaining the direction of the screening deck by having each point of the screening deck revolve along a circular path of the same size.

3. The method of claim 1, wherein the revolving motion speed of the screening deck is selected so that the material to be screened is thrown by the screening deck in the same advancing direction over each cycle as regarded in the direction of the screening deck's plane.

4. The method of claim 1, wherein driving the screening deck includes driving the screening deck in a revolving motion with the rotatable eccentric shafts, wherein the eccentric forces of the eccentric shafts are balanced with one or more counterweights, some of which are rotated along with the eccentric shafts and some of which are driven in the same revolving motion as the screening deck.

5. The method of claim 1, further comprising bringing the materials to be screened into a screening space defined by the body, wherein the screening space is restricted by flexible sealing boards that move along with the screening deck and whose top edges drag against immobile end panels.

6. A device for screening materials, comprising:

a body;

a meshed screening deck;

a fastening frame for the screening deck;

at least two horizontal eccentric shafts supporting the screening deck on the body, where the eccentric shafts are configured to be driven relative to the body; and a motor configured for rotating the eccentric shafts;

wherein each eccentric shaft is bearing-mounted on the body with a first bearing such that a rotation axis of the eccentric shaft extends through a midpoint of the first bearing; and each eccentric shaft is bearing-mounted on the fastening frame of the screening deck with a second bearing such that a throw axis that is spaced from the rotation axis of the eccentric shaft extends through the midpoint of the second bearing;

so that when the device is operating each throw axis revolves around the corresponding rotation axis along a circular path continuously in the same direction, the joint center of mass of movable structural components is disposed substantially along a plane that extends through and includes the rotation axes, and all mass forces of structural components are balanced with respect to the rotation axes.

7. The device of claim 6, wherein that the joint center of mass of movable structural components is disposed substantially at the center of the plane that extends through and includes the rotation axes.

8. The device of claim 6, wherein the mass of each eccentric shaft bearing-mounted on the corresponding throw axis has been balanced with respect to the throw axis.

9. The device of claim 6, wherein the eccentric shafts are linked to each other with a mechanical transmission, such that the eccentric shafts are forced to rotate synchronously in the same direction.

10. The device of claim 6, wherein to the end of each eccentric shaft extended through the body is attached a counterweight, such that the counterweight is in a high position whenever the screening deck and its fastening frame are in a low position, thereby balancing dynamic eccentric forces.

11. The device of claim 10, wherein to a lower portion of the screening deck fastening frame, below the eccentric shafts, is attached a bottom weight in order to lower the center of mass of the screening deck and its fastening frame.

12. The device of claim 6, wherein the screening deck defines a bottom or a wall for a bucket-shaped screen device.

13. The device of claim 6, wherein, in order to adjust screening coarseness, the screening deck includes two screening decks on top of each other, the upper screening deck being attached to the screening deck fastening frame and the lower screening deck being movable between the upper screening deck and the fastening frame.

* * * * *